US012378973B2

(12) United States Patent
Zhu

(10) Patent No.: US 12,378,973 B2
(45) Date of Patent: Aug. 5, 2025

(54) MODULAR TOWER FAN

(71) Applicant: MAXTON ENGINEERING LTD., Central (HK)

(72) Inventor: Shou Qiang Zhu, La Verne, CA (US)

(73) Assignee: MAXTON ENGINEERING LTD., Central (HK)

( * ) Notice: Subject to any disclaimer, the term of this patent is extended or adjusted under 35 U.S.C. 154(b) by 0 days.

(21) Appl. No.: 18/175,386

(22) Filed: Feb. 27, 2023

(65) Prior Publication Data

US 2023/0332624 A1 Oct. 19, 2023

Related U.S. Application Data

(60) Provisional application No. 63/314,367, filed on Feb. 25, 2022.

(51) Int. Cl.
*F04D 17/04* (2006.01)
*F04D 25/06* (2006.01)
*F04D 29/60* (2006.01)

(52) U.S. Cl.
CPC ..... *F04D 29/601* (2013.01); *F04D 17/04* (2013.01); *F04D 25/06* (2013.01)

(58) Field of Classification Search
CPC ..... F04D 29/601; F04D 25/06; F04D 25/08; F04D 17/04
See application file for complete search history.

(56) References Cited

U.S. PATENT DOCUMENTS

D603,036 S * 10/2009 Boswell ..... D23/378
2011/0110805 A1* 5/2011 Gammack ..... F04B 49/00 417/423.1
2015/0204340 A1* 7/2015 Chan ..... F04D 19/002 417/45
2019/0334468 A1* 10/2019 Stauffer ..... F04D 25/08
2021/0262480 A1* 8/2021 Botkin ..... F04D 29/522

FOREIGN PATENT DOCUMENTS

CN 205977739 U * 2/2017
CN 206592312 U * 10/2017
WO WO-2016115830 A1 * 7/2016 ..... F04D 25/08

* cited by examiner

*Primary Examiner* — Thomas Fink
(74) *Attorney, Agent, or Firm* — LIU & LIU

(57) ABSTRACT

A modular tower fan comprising a fan module having a fan housing wherein the fan housing comprises a blower fan and bearings supporting the blower fan for rotation within the fan housing, and a fan gear provided at a bottom of the fan housing; and a drive module having a drive housing, wherein the drive module comprises a drive motor, control circuitry, wirings and other electrical components within the drive housing, and a drive gear at a top of the drive housing; wherein the fan housing of the fan module is removably/detachably attached to the drive housing of the drive module with the fan gear operational coupled to the drive gear for rotation, and wherein the fan module is detachable from the drive module for cleaning mode, shipping or storage with the fan gear decoupled from the drive gear.

9 Claims, 14 Drawing Sheets

FIG. 6A
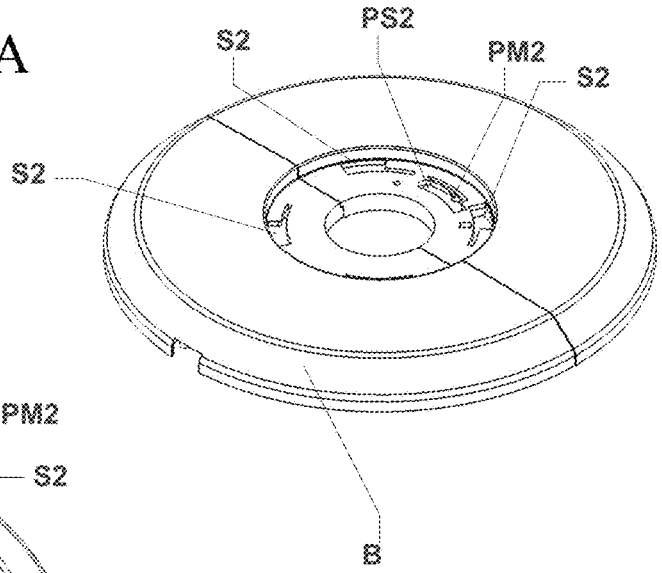
FIG. 6B
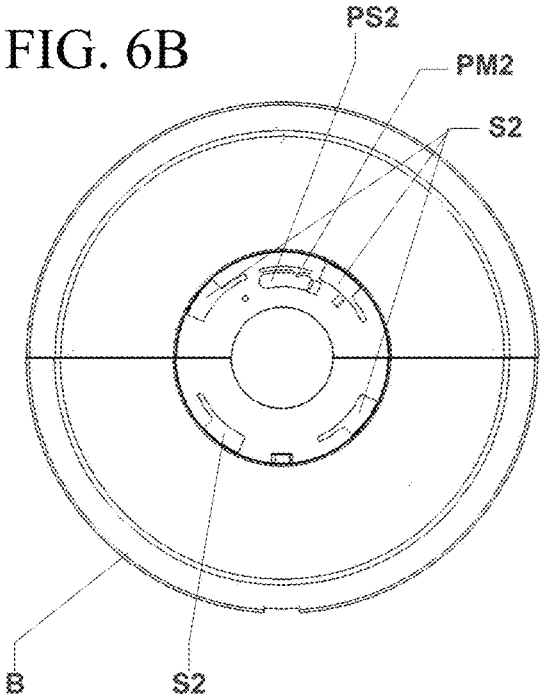
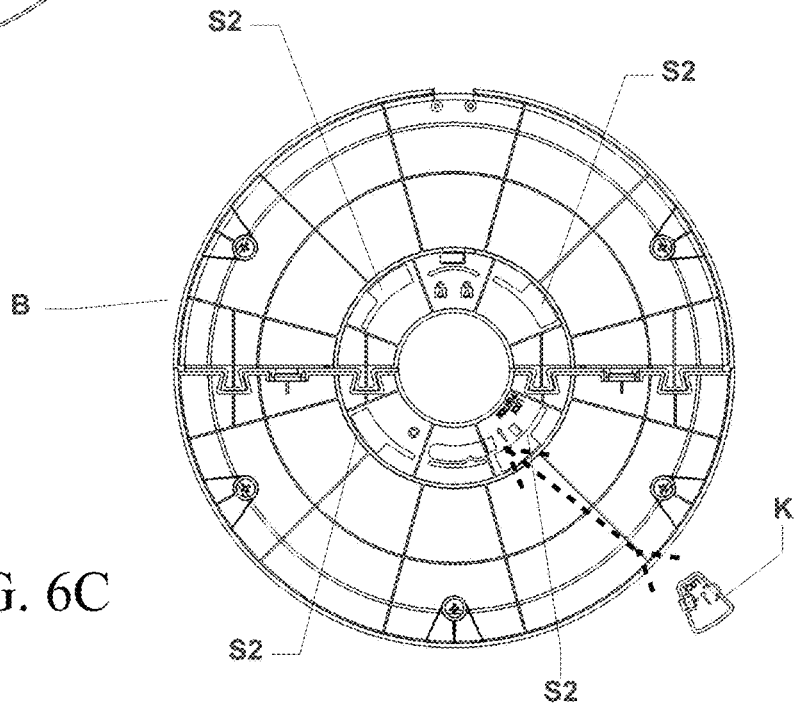
FIG. 6C

MODULAR TOWER FAN

PRIORITY CLAIM

This application claims the priorities of U.S. Provisional Patent Application No. 63/314,367 filed on Feb. 25, 2022. This application is fully incorporated by reference as if fully set forth herein. All publications noted below are fully incorporated by reference as if fully set forth herein.

FIELD OF THE INVENTION

The present invention is directed to a vertical tower fan.

BACKGROUND OF THE INVENTION

Heretofore, conventional vertical tower fan generally comprises a blower fan and a drive motor that are enclosed in a cylindrical housing. The blower fan rotates about a vertical axis driven by the drive motor within the base of the housing. The housing includes an array of vented openings, louvers and the like to allow air to flow into the housing to be blown out by the vertically rotating blower fan. The blower fan includes an array of longitudinal blades arranged radially about the rotation axis, each extending vertically parallel to the rotation axis. The base of the blower fan is coupled by a vertical drive shaft to the drive motor at the base of the housing. The housing is rotatably supported on a support base in an oscillating manner, so air can be directed in changing directions as the housing is rotated in oscillation with respect to the support base during operation. At the top of the housing, to provide a user easy access to operating the tower fan, a user control module/panel (e.g., control buttons and switches) is provided at the top of the tower housing, which the user can use to control operation of the tower fan (e.g., on/off, speed, mode, timer, etc.) Control wirings run within the housing, from the top of the housing to the drive motor within the base of the housing. For some tower fans, a remote control is provided which wirelessly communicate with a receiver at the control module provided at the top of the tower fan.

Through use, the blower fan blades and the air vents/openings/grills/louvers tend to accumulate dust, dirt and grime during the process of moving air through the array of fan blades (i.e., the blower fan sucking air into the housing and blowing air out of the housing). Heretofore, conventional tower fans are not designed and structured to allow user access to the interior of the housing to clean the blower fan blades, short of using tools needed to disassemble the housing. One cannot and should not, e.g., direct a water jet from outside the housing at the fan blades to try to clean the blower fan blades as there are electrical components (e.g., drive motor, control circuitry and wirings) that should not be exposed to water to avoid electrical hazards.

Furthermore, given the positioning of the user control panel at the top of the tower fan housing, wirings need to be run along the inside wall of the housing, thus complicating assembly during manufacturing.

U.S. Pat. No. 10,584,707 discloses a vertical tower fan that can be easily assembled and disassembled for cleaning. Specifically, it discloses and claims a method for assembling a vertical tower fan comprising steps of: providing a main body of the tower fan that has a receiving space for a fan unit that has a shaft extending from a top portion thereof; inserting the fan unit into the receiving space; and putting a front cover and a rear cover to the main body of the tower fan in a "snap-in" manner, wherein a securing unit is disposed at a top portion of the receiving space to secure a top portion of the fan unit, and a fan receiving hole is formed at a bottom portion of the fan unit to receive a protrusion at a bottom portion of the receiving space, so the fan unit is secured on both the top and bottom portions in the receiving space, wherein the securing unit is supported by one or more resilient units, so the securing unit is configured to move vertically from one position to another position within a predetermined distance underneath the control unit, and the top portion of the shaft is secured in the receiving space by inserting the shaft into a receiving hole of the securing unit when the securing unit is vertically lifted up. It further discloses and claims the vertical tower fan can be quickly disassembled by removing the front and rear covers from the vertical fan; lifting the securing unit to release the top portion of the shaft from the securing unit; and removing the bottom portion of the shaft from the protrusion.

While the '707 patent provides an option for user to easily open the housing and access the interior of the housing to clean the blower fan blades, it remains challenging to avoid exposing the electrical components within the housing to fluid (e.g., water and cleaning fluid). Wirings are needed to be run through the inside of the housing, which user must avoid tempering with when opening the housing to clean the fan blades.

Therefore, there remains a need for a new and improved design for a vertical tower fan to overcome the problems stated above.

SUMMARY OF THE INVENTION

The present invention provides a tower fan that is modularized, with a separate fan module and a separate drive module (comprising all the electric components, e.g., drive motor, control circuitry, wirings and other electrical components that should not be exposed to fluid during cleaning). The fan module is removably/detachably attached (e.g., by a plug and twist locking interface, threaded interface, and/or fasterners) to the drive module during operation mode, by removably/detachably attaching the base of the fan module to the top of the drive module. The fan module is detachable from the drive module, e.g., for cleaning mode, shipping, storing, etc.

In accordance with one aspect, the present invention is directed to a modular tower fan, comprising a fan module having a fan housing, wherein the fan housing comprises a blower fan and bearings supporting the blower fan for rotation within the fan housing, and a fan gear provided at a bottom of the fan housing for rotating the blower fan (e.g., via a lower fan shaft); a drive module having a drive housing, wherein the drive module comprises a drive motor, control circuitry, wirings and other electrical components within the drive housing, and a drive gear at a top of the drive housing driven by the drive motor (e.g., via a drive shaft); wherein the fan housing of the fan module is removably/detachably attached to the drive housing of the drive module with the fan gear operational coupled to the drive gear for rotation, and wherein the fan module is user detachable from the drive module for cleaning mode, shipping or storage with the fan gear decoupled from the drive gear, without requiring using a hand tool such as plier, screw driver In one embodiment, the fan module includes a blower fan supported by bearings and the like for rotation within a longitudinal, generally cylindrical fan housing. The blower fan rotates about a longitudinal/vertical axis in the longitudinal fan housing, supported by bearings provided at the two ends of the longitudinal axis within the fan housing. The fan housing includes an array of vented openings, louvers, grills and the like to allow air to flow into the housing to be blown out of the housing by the rotating blower fan. The blower fan includes an array of longitudinal blades arranged radially about a central hub and the rotation axis, each extending/spanning vertically parallel to the rotation axis to form a wheel shaped blower fan (often referred as a "squirrel cage" blower). A fan gear is provided at the bottom end of the fan shaft outside the bottom of the fan housing for coupling to the complementary drive gear at the top of the drive module. The fan shaft may be supported to extend from the bearing within the fan housing located at the bottom end of the longitudinal axis of the rotating blower fan.

In one embodiment, the drive module includes a drive motor supported within a drive housing. Within the drive housing are also all the electrical components/electronics, control module, control circuitry, wirings, etc. The drive motor has a drive shaft supported on a bearing for rotation, extending to outside the top of the drive housing. A drive gear is provided at the top end of the drive shaft outside the top of the drive housing for coupling to the fan gear below the bottom of the fan housing.

In one embodiment, to removably/detachably engage the fan module/housing to the drive module/housing, the bottom of the fan module/housing is rested over the top of the drive housing, and the fan module/housing is twisted with respect to the drive housing to interlock the complementary lugs and slots provided at the interfacing fan module/housing bottom and drive housing top. To disengage the fan module/housing from the drive module/housing, the fan housing is twisted in the opposite direction in relation to the drive housing.

In another embodiment, the drive housing and the fan housing may be removably/detachably coupled by a threaded interface between the bottom of the fan housing and the top of the drive housing.

In a further embodiment, the drive housing and the fan housing may be removably/detachably coupled using one or more fasteners (e.g., screws, bolts, snaps, inserts, tabs, straps, keys, twist knobs, and the like) that permits the user to easily undo the fasteners to allow the drive housing and the fan housing to be separated.

The drive module may include an oscillation support that is part of the drive module. In one embodiment, the oscillation support is located outside the bottom end of the drive housing. In one embodiment, the drive motor may be supported by a drive frame within and towards the top of the drive housing. A separate, smaller, oscillation drive motor is provided in the housing, attached to the top of the oscillation support, to rotate the drive housing, via a set of oscillation drive gears and/or levers, in relation to the oscillation support in an oscillating or swinging manner.

The bottom of the drive module may be attached to a supporting base. In one embodiment, the oscillation support of the drive module is fixedly attached (which may be removably attached using removable fasteners or lugs/slots) to a wider ground support base to provide a sturdier support of the overall tower fan structure. Hence, the drive housing is driven to rotate in oscillation with respect to the ground support base.

User control of the tower fan may be provided by a user control interface (e.g., comprising one or more switches/buttons) provided on the drive housing, and/or a wireless control (e.g., a wireless remote control) that communicates wirelessly (e.g., by Bluetooth, wife, infrared, RF, etc.) with a receiver provided in a control module provided within the drive module/housing. To facilitate ease of user control of the tower fan, the remote control may be removably/detachably attached to the fan housing (e.g., at the top of the fan housing). In one embodiment, the remote control may be magnetically attached to the fan housing, or by means of Velcro fasteners, snap fasteners, hook fasteners, pocket, docking slot, etc. In another embodiment, a wireless control could be permanently or semi-permanently housed in a detachable or non-detachable, waterproof or water-insulated chamber of the fan housing, so that only a small limited part of the fan housing contains well insulated low voltage electronics/electrical components. In any event, wiring is not needed to communicate limited control signals between the wireless control and the drive module. In yet another embodiment, alternatively or in addition, an application module installed in an electronic device (e.g., a mobile phone) may be used to generate the remote-control signal, and further to include additional 'smart' monitoring and/or control functions.

BRIEF DESCRIPTION OF THE DRAWINGS

For a fuller understanding of the nature and advantages of the invention, as well as the preferred mode of use, reference should be made to the following detailed description read in conjunction with the accompanying drawings. In the following drawings, like reference numerals/designations designate like or similar parts throughout the drawings.

FIGS. 6A to 6C are respectively perspective view, top plan view, and bottom plan view of a ground support base, in accordance with one embodiment of the present invention.

DESCRIPTION OF ILLUSTRATED EMBODIMENTS

Figure 1A:
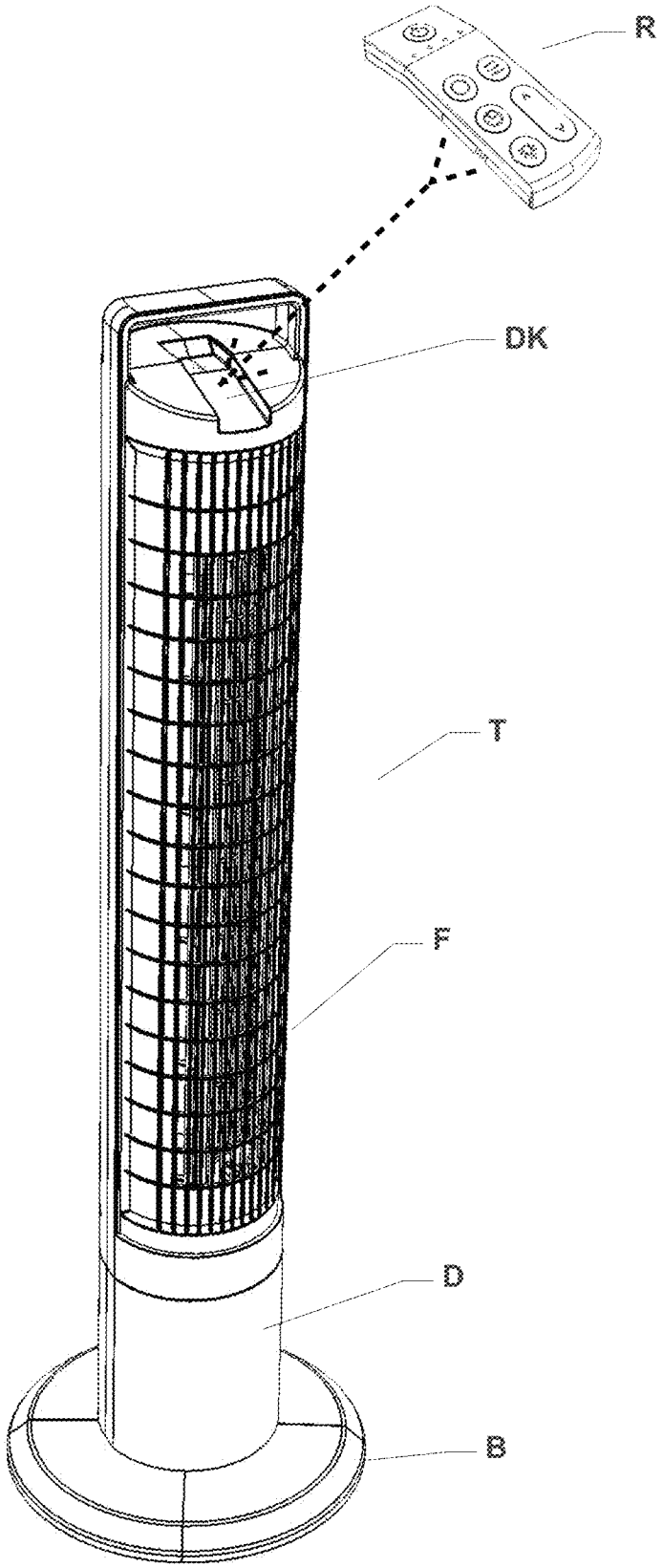
FIGS. 1A to 1C are respectively front view, rear view, and sectional perspective view of a modular tower fan, in accordance with one embodiment of the present invention.
Figure 1B:
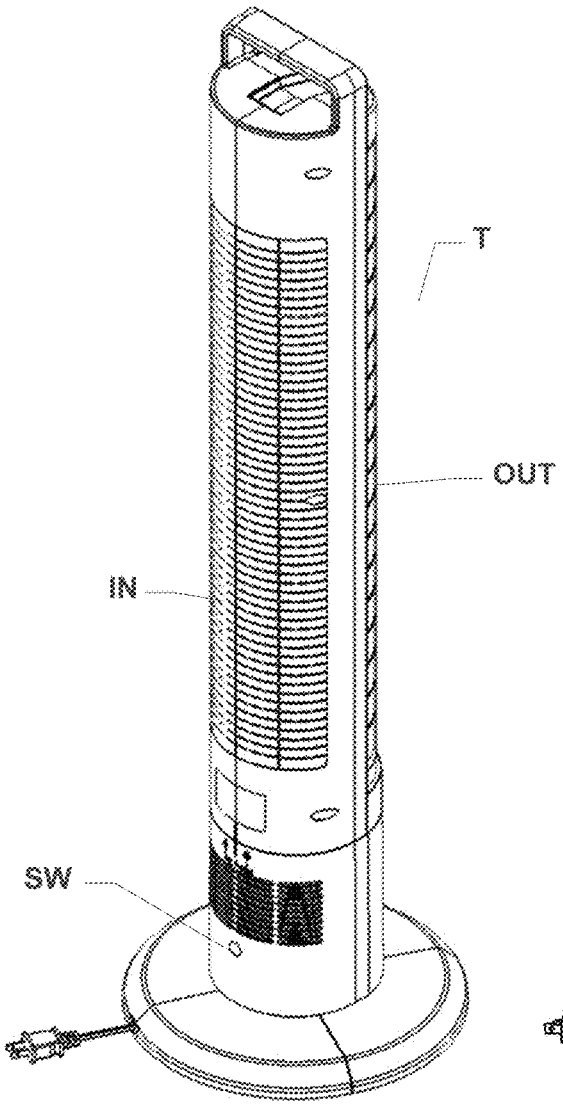
Figure 1C:
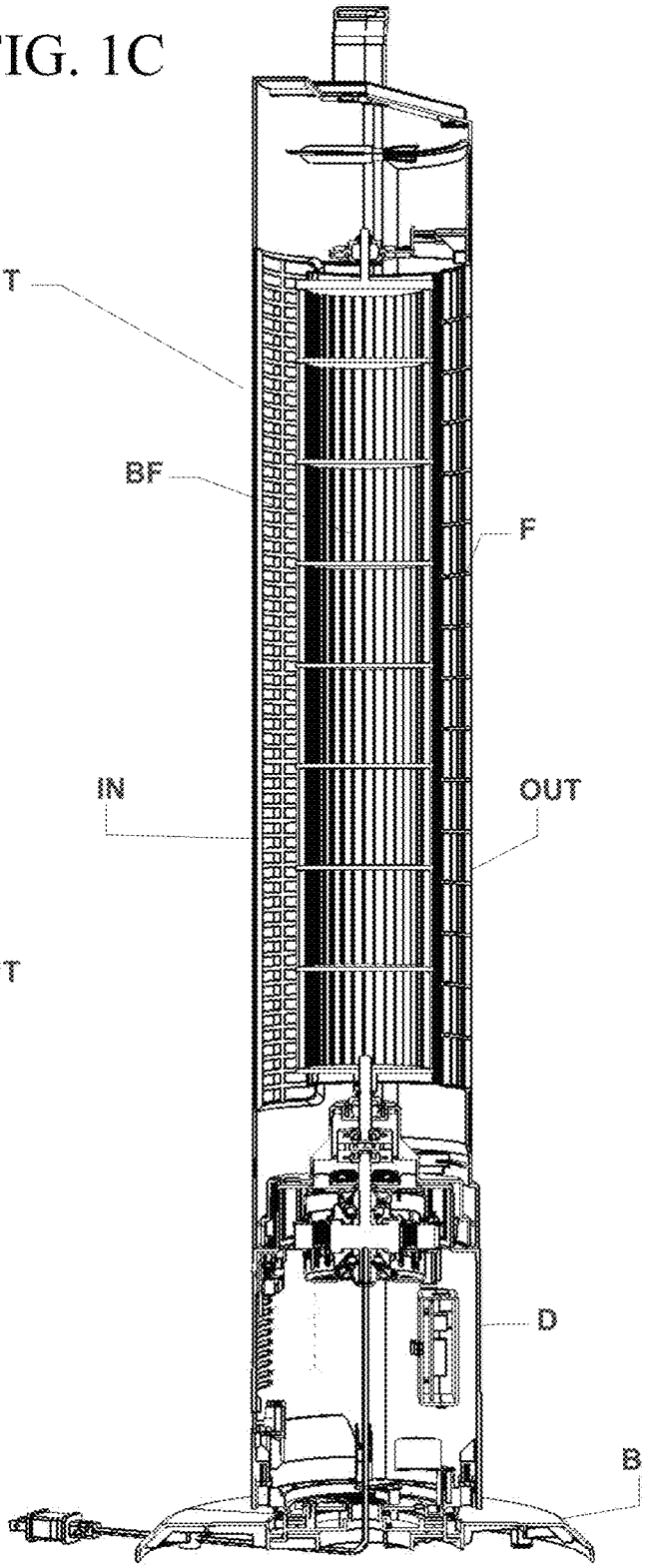
Figure 2A:
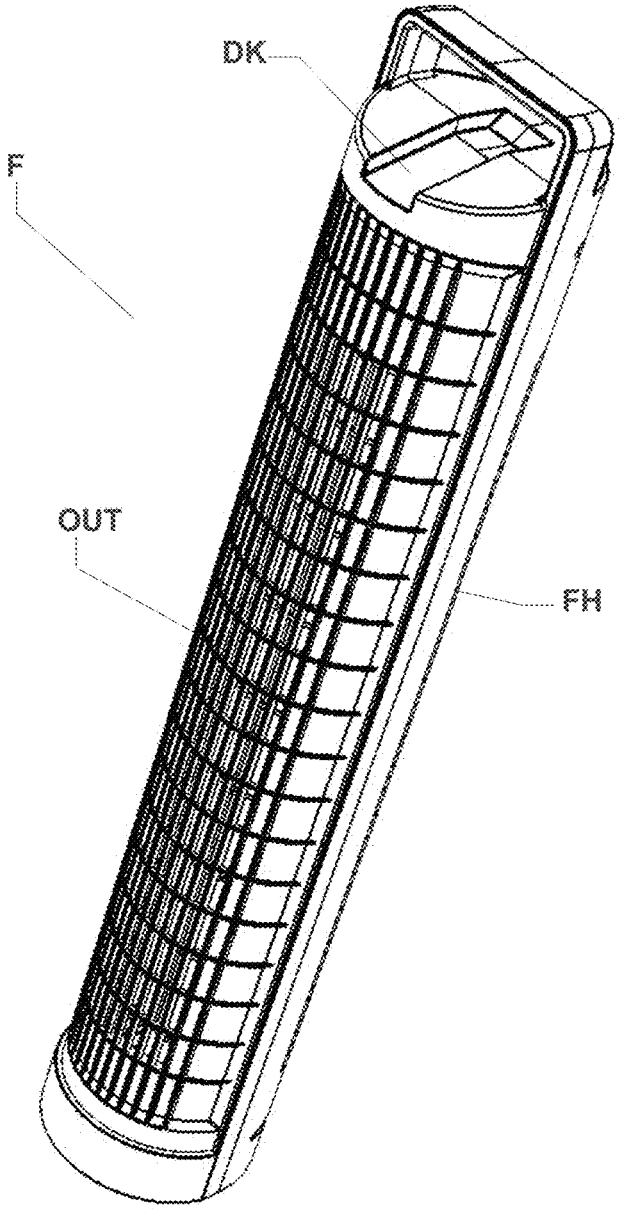
FIGS. 2A to 2E are respectively front perspective view, rear perspective view, sectional view, sectional perspective view, and bottom plan view of a fan module, in accordance with one embodiment of the present invention.
Figure 2B:
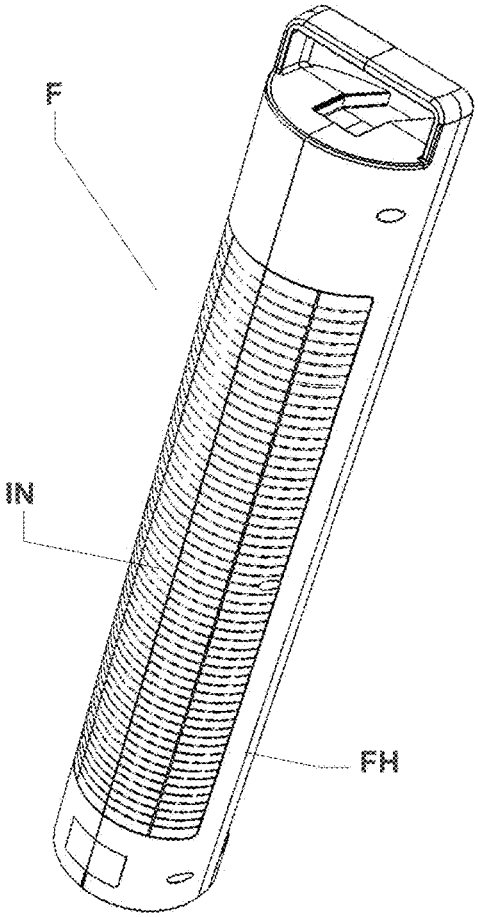
Figure 2C:
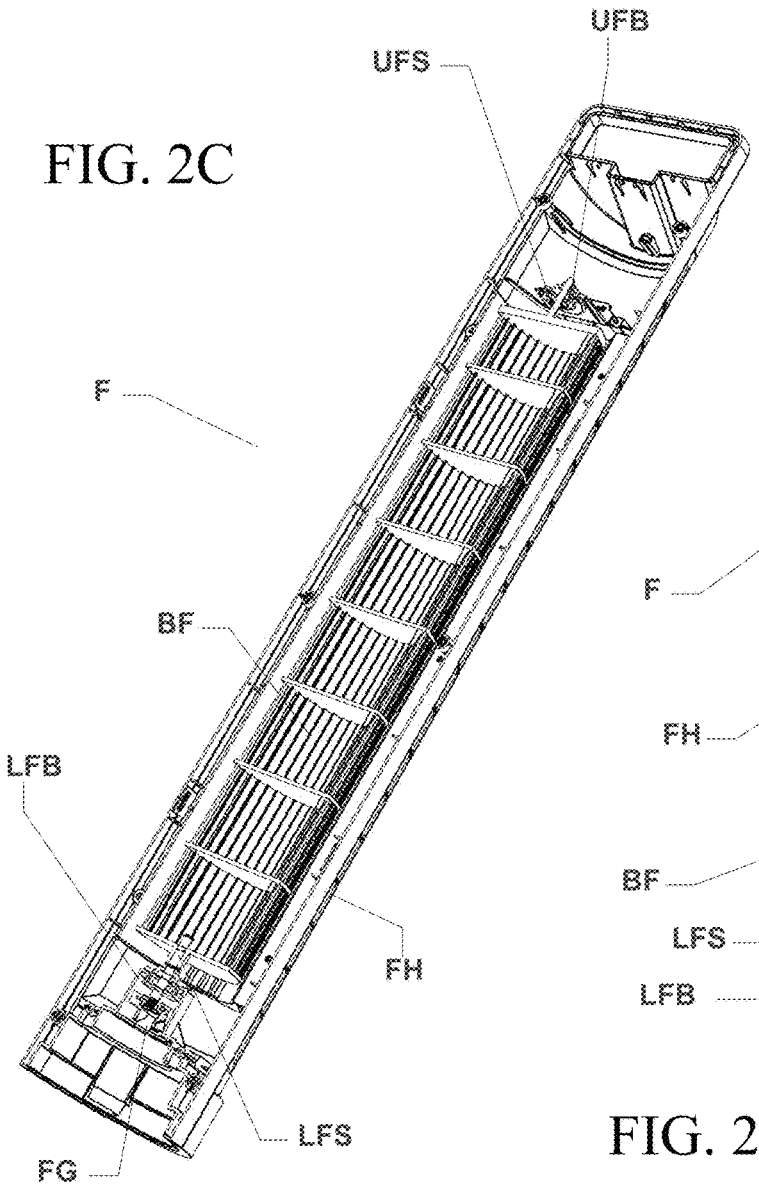
Figure 2D:
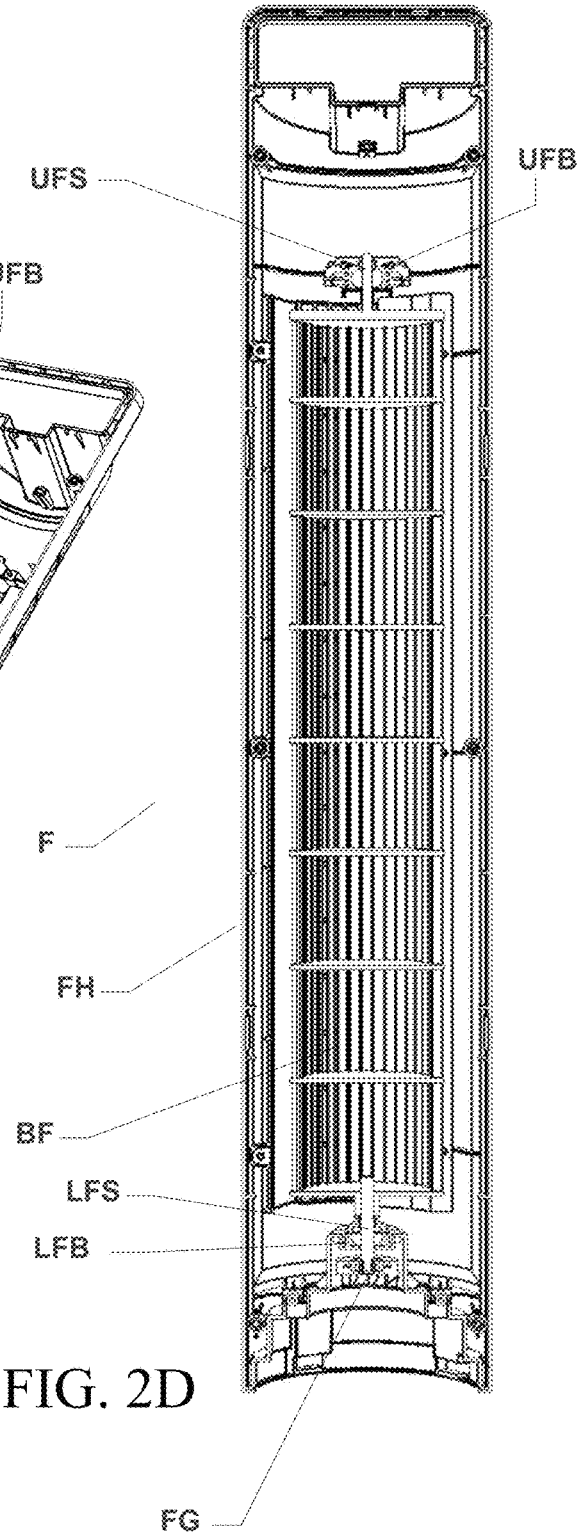
Figure 2E:
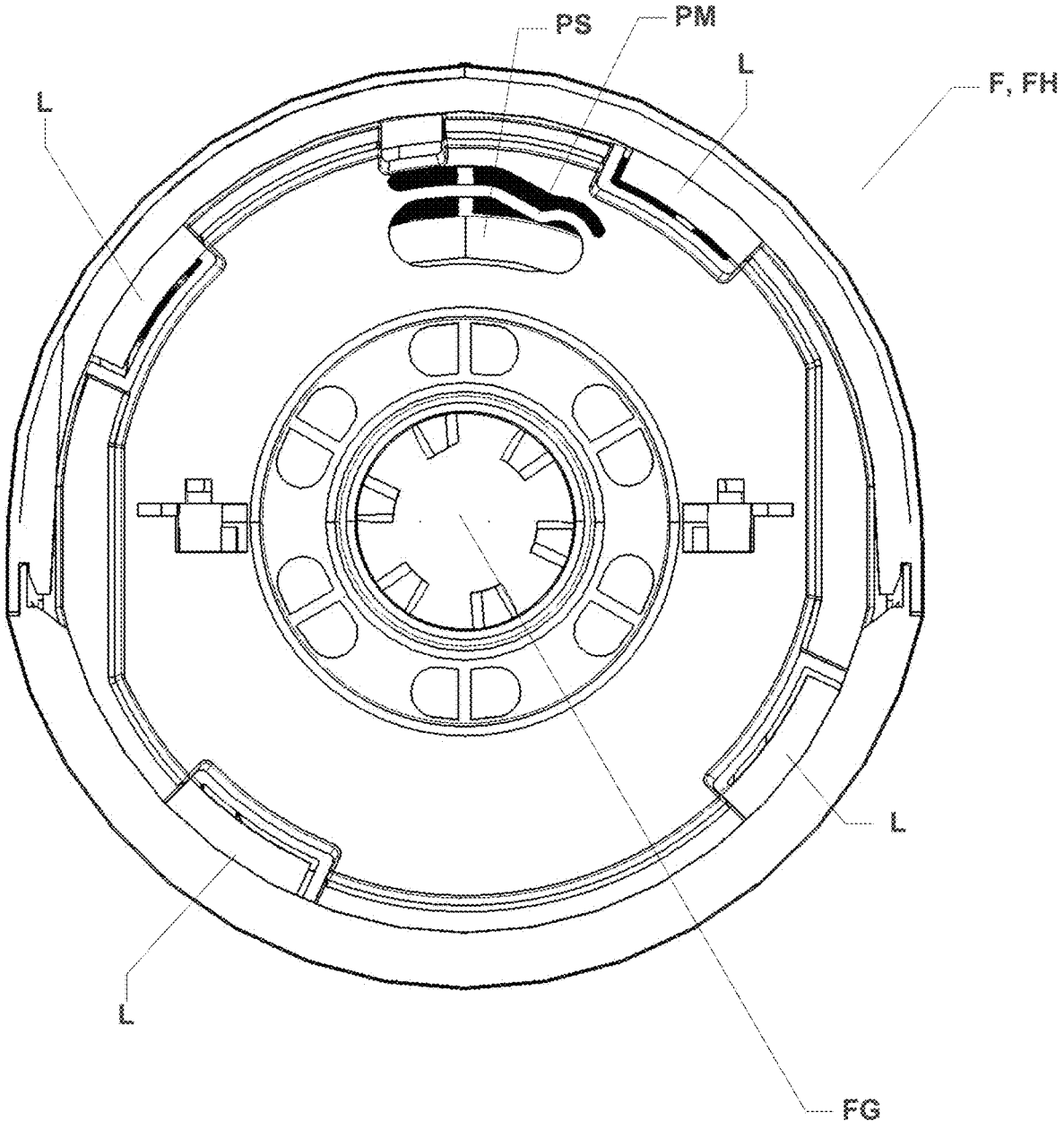
Figure 3A:
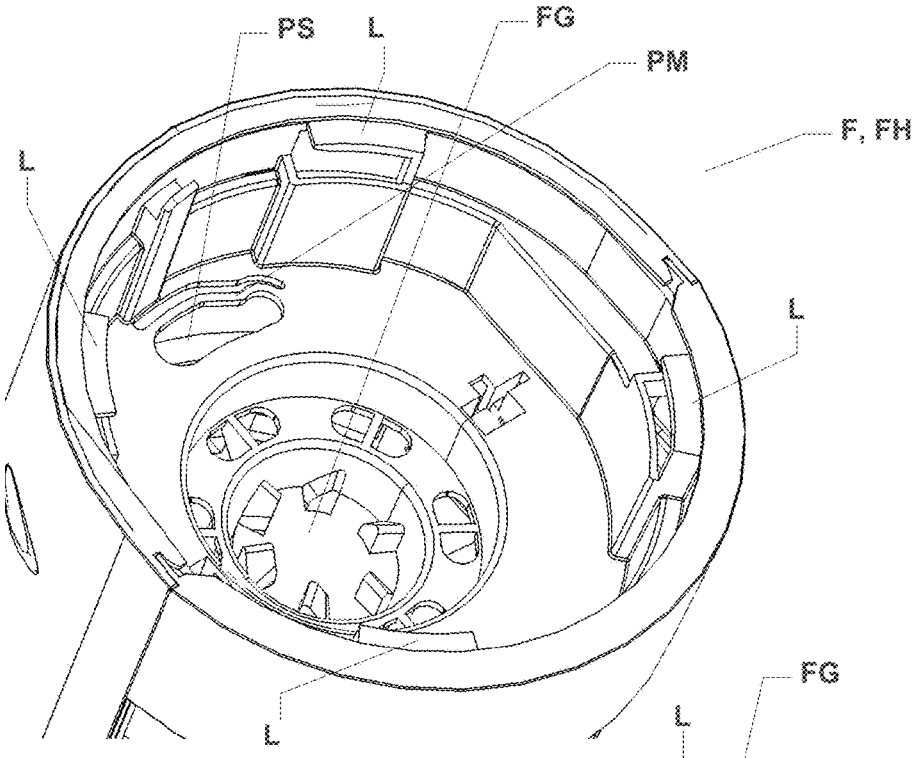
FIGS. 3A to 3D are respectively perspective views (at two angles 180-degrees apart), sectional view, and sectional perspective view of the base portion of a fan module, in accordance with one embodiment of the present invention.
Figure 3B:
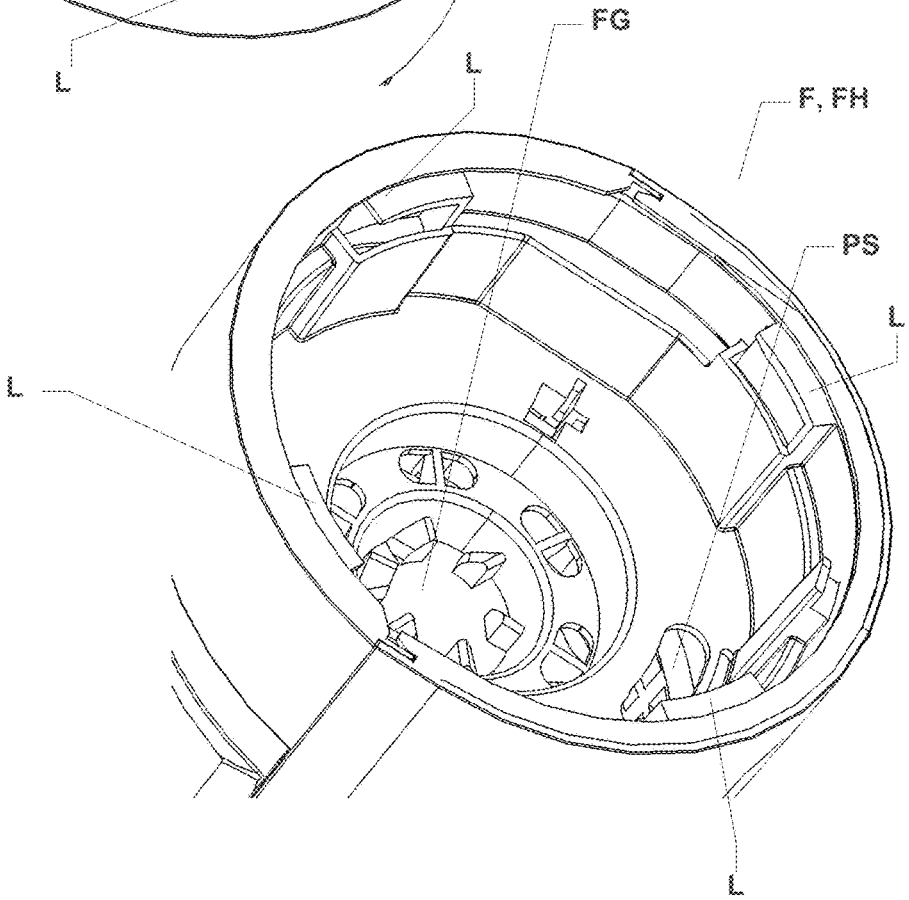
Figure 3C:
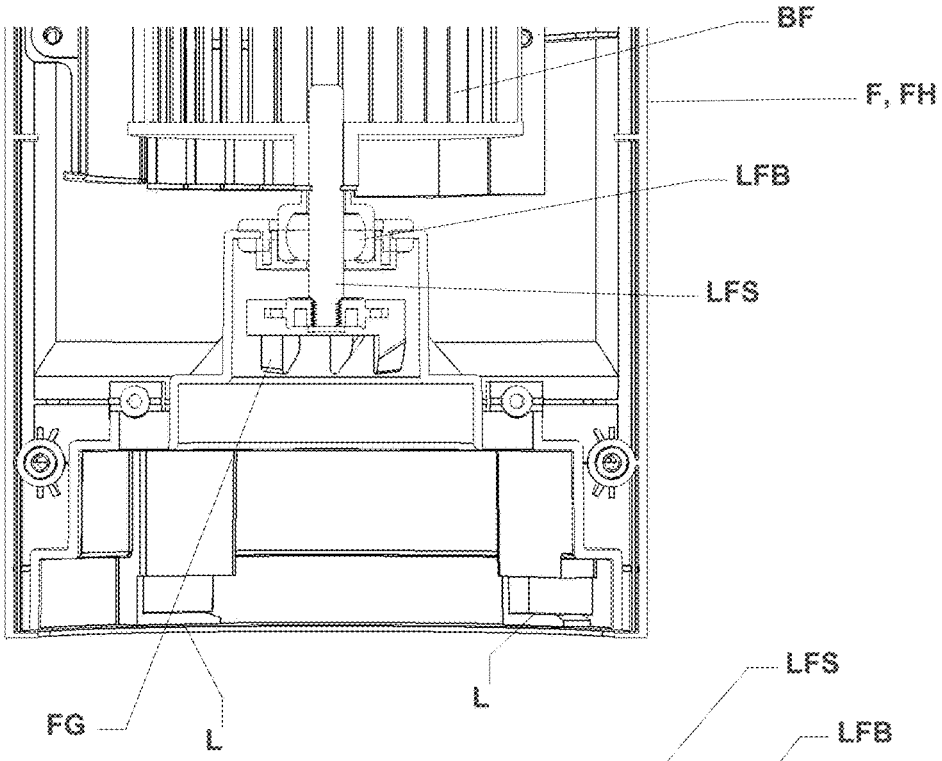
Figure 3D:
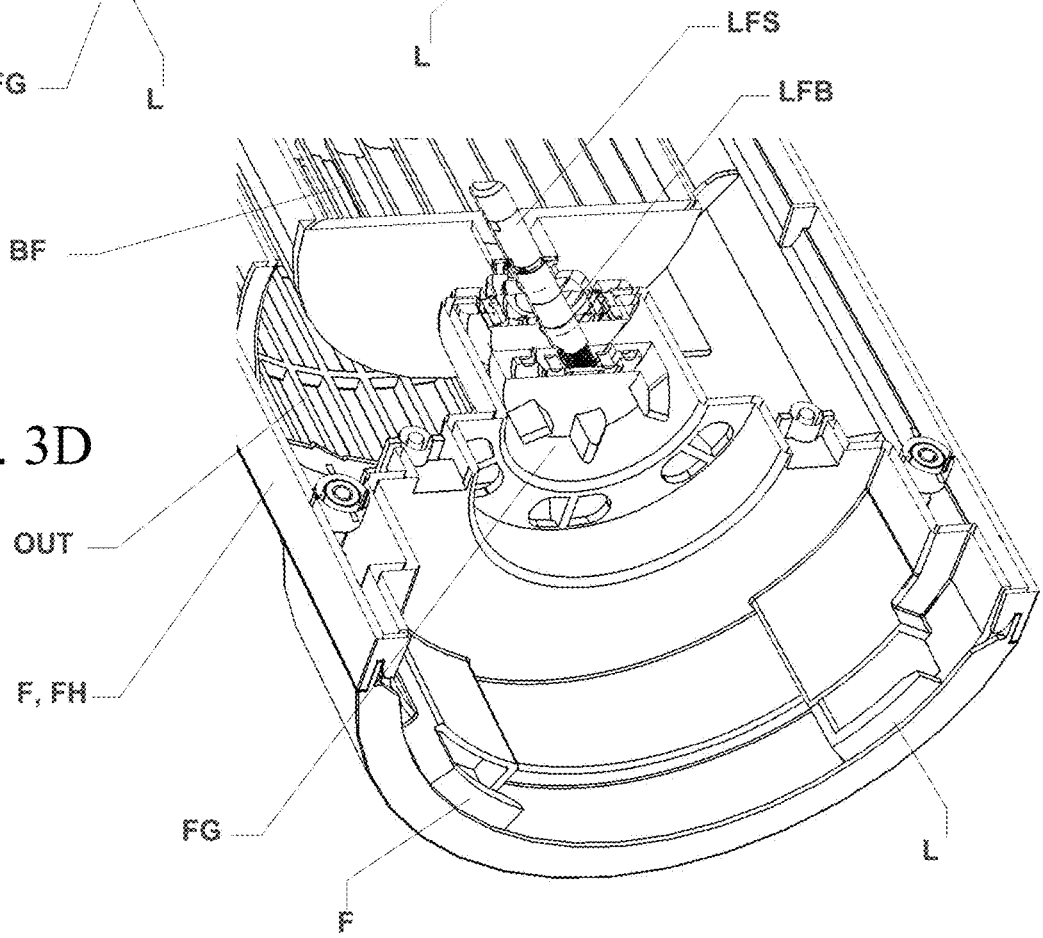
Figure 4A:
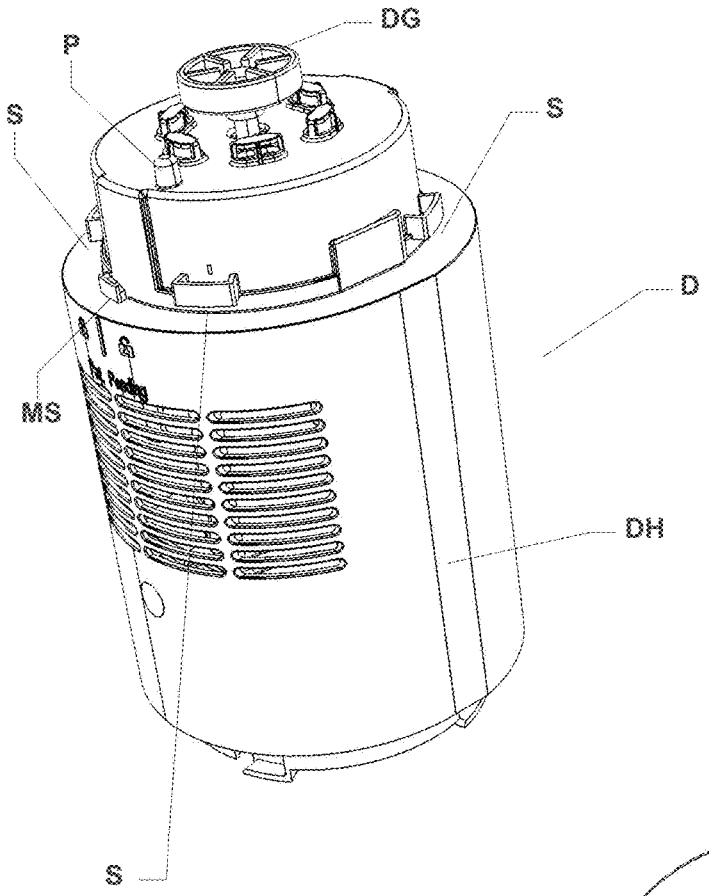
FIGS. 4A to 4H are top perspective view, bottom perspective view, top plan view, bottom plan view, rear view, side view, sectional view, and sectional perspective view of a drive module, in accordance with one embodiment of the present invention.
Figure 4B:
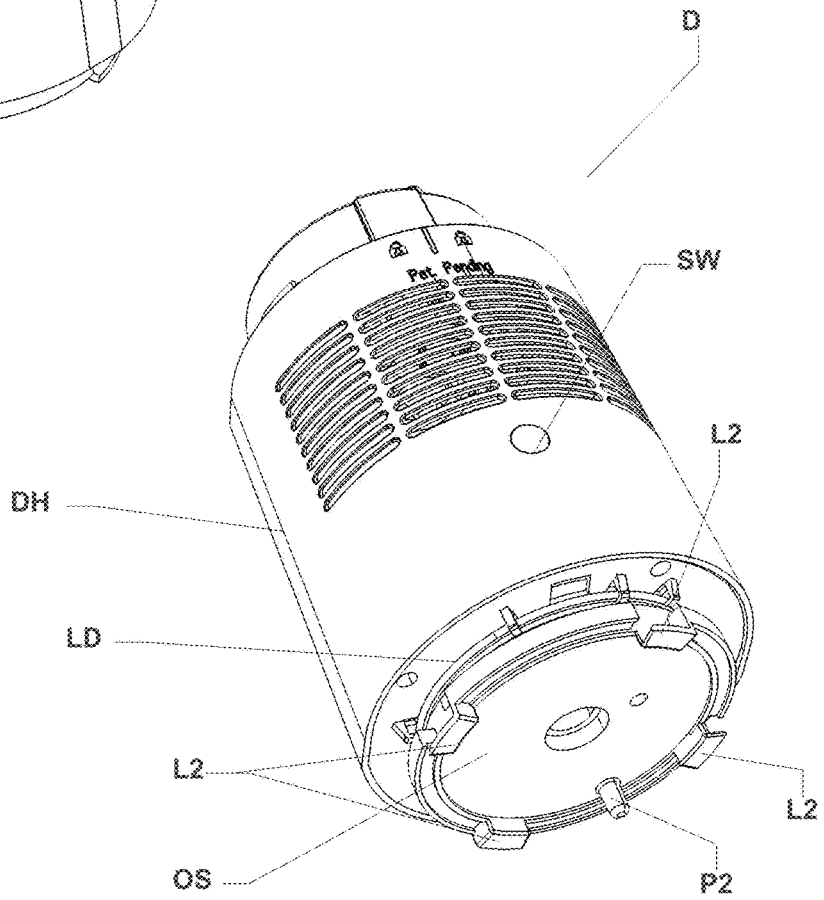
Figure 4C:
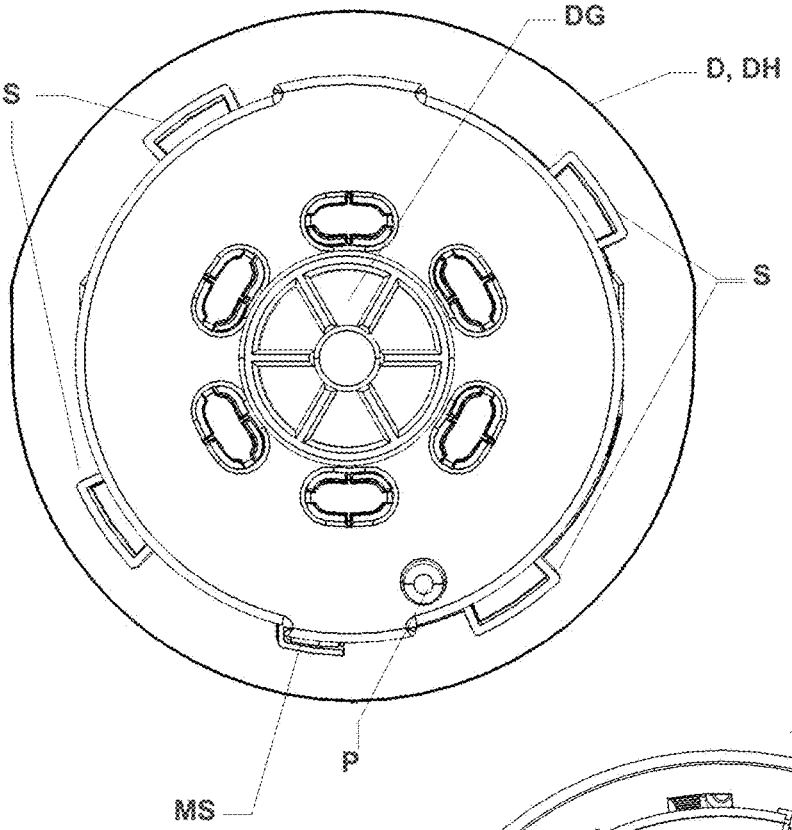
Figure 4D:
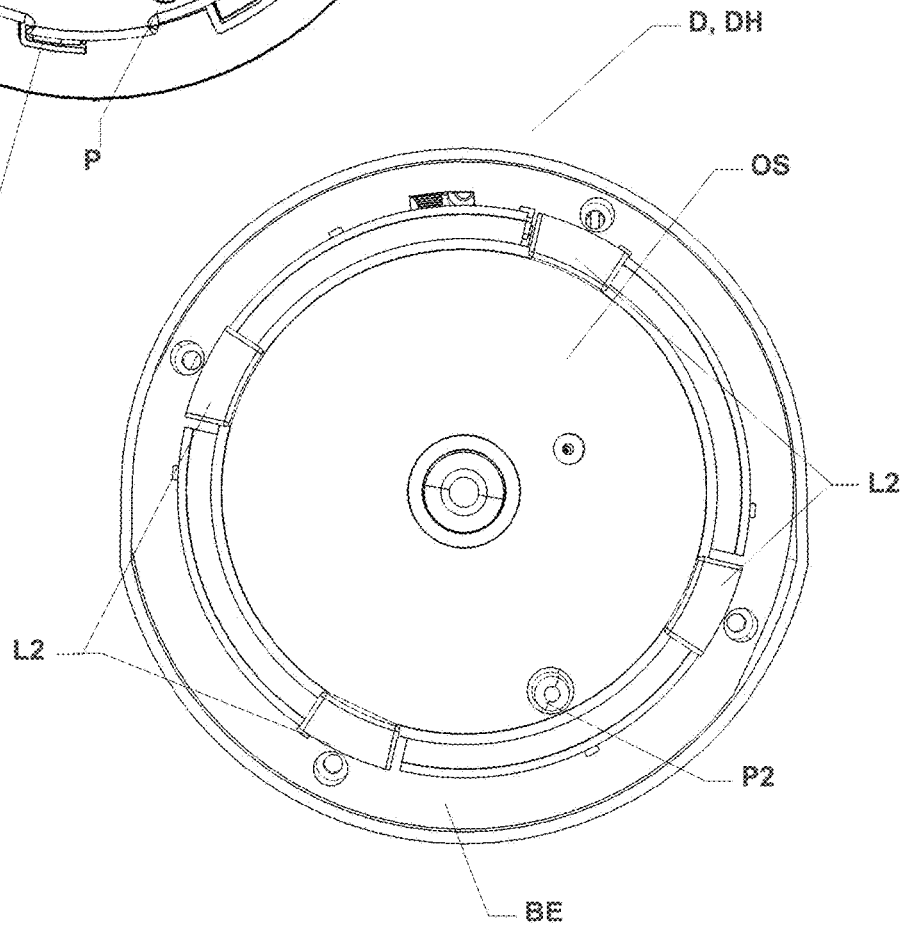
Figure 4E:
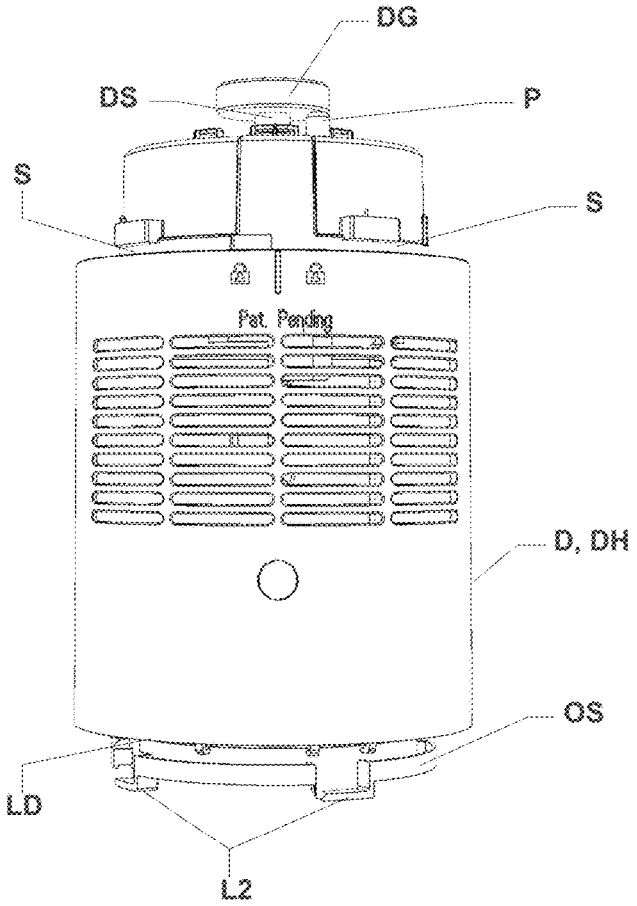
Figure 4F:
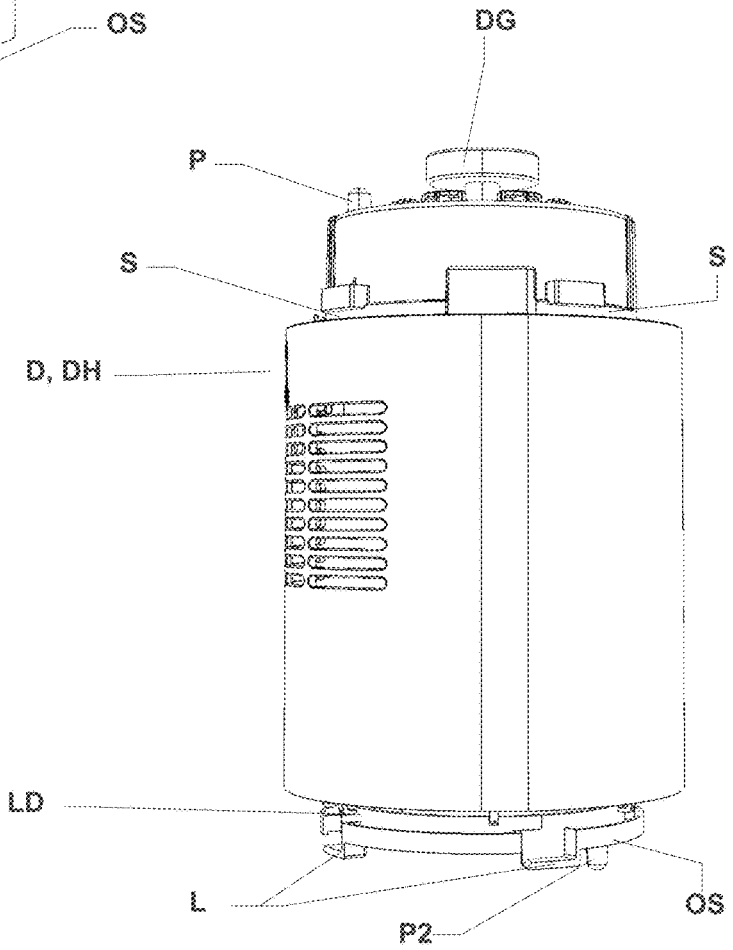
Figure 4G:
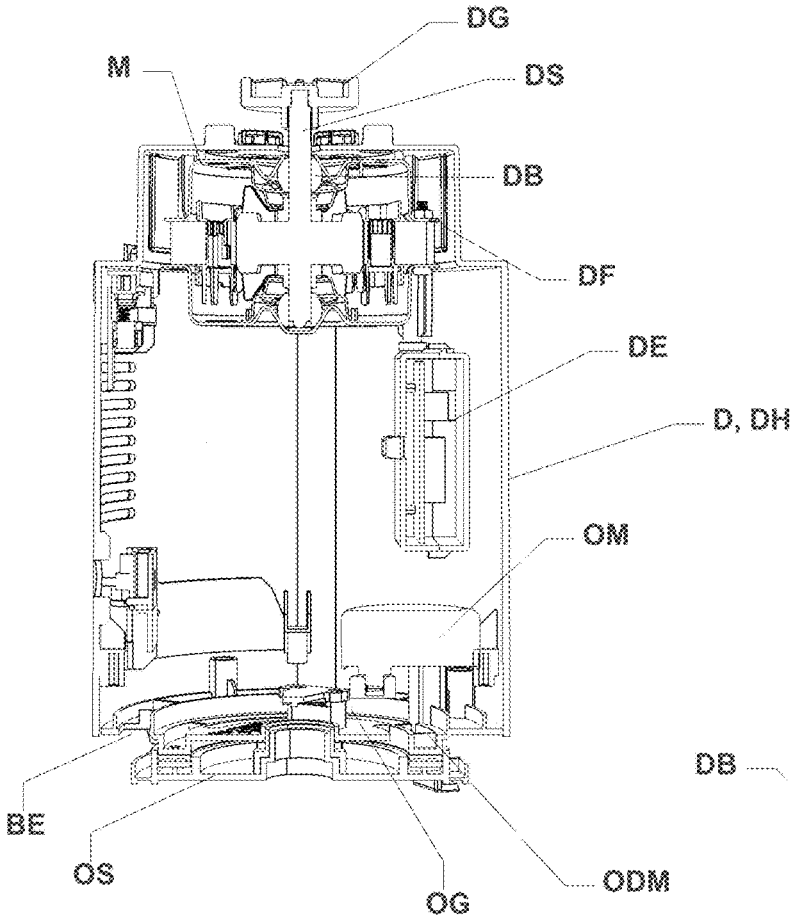
Figure 4H:
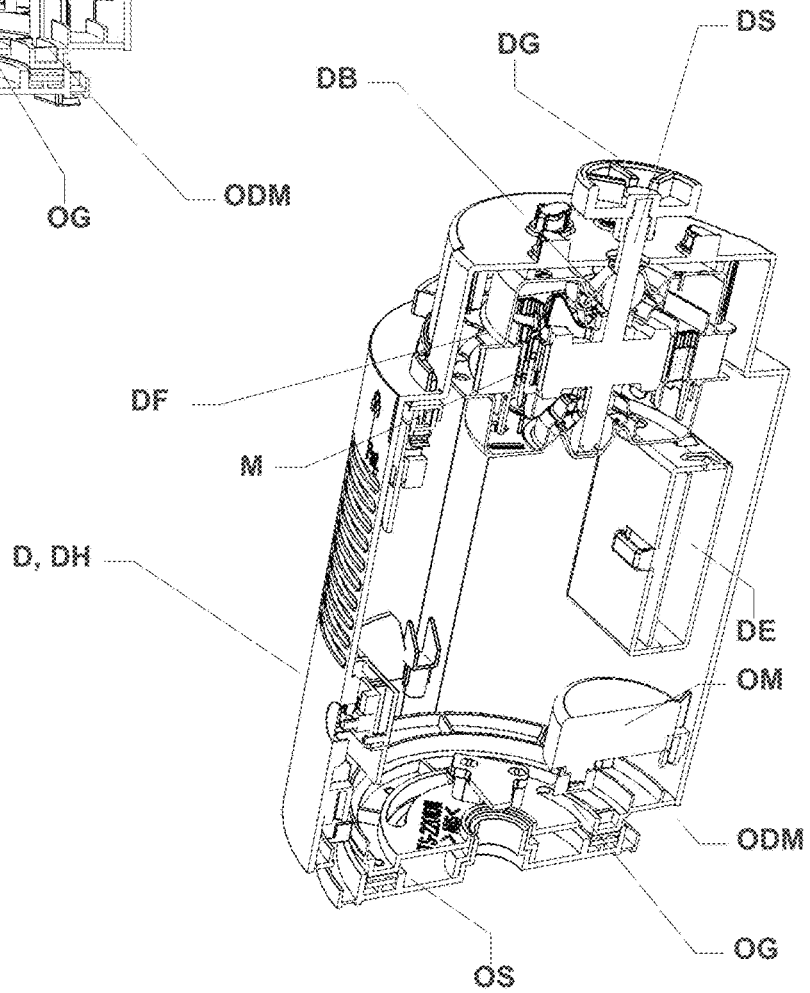
Figure 5A:
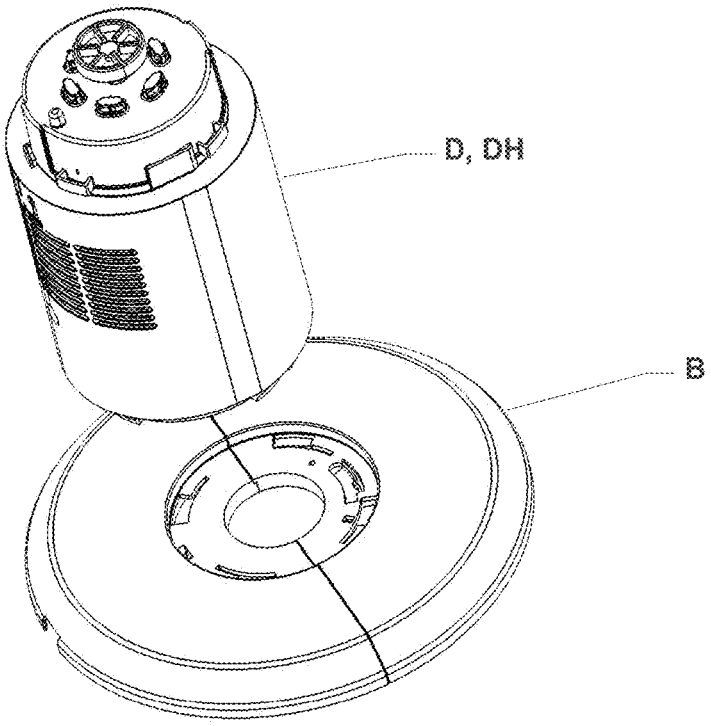
FIGS. 5A to 5B are respectively perspective view and sectional view of a drive module and a ground support base, in accordance with one embodiment of the present invention.
Figure 5B:
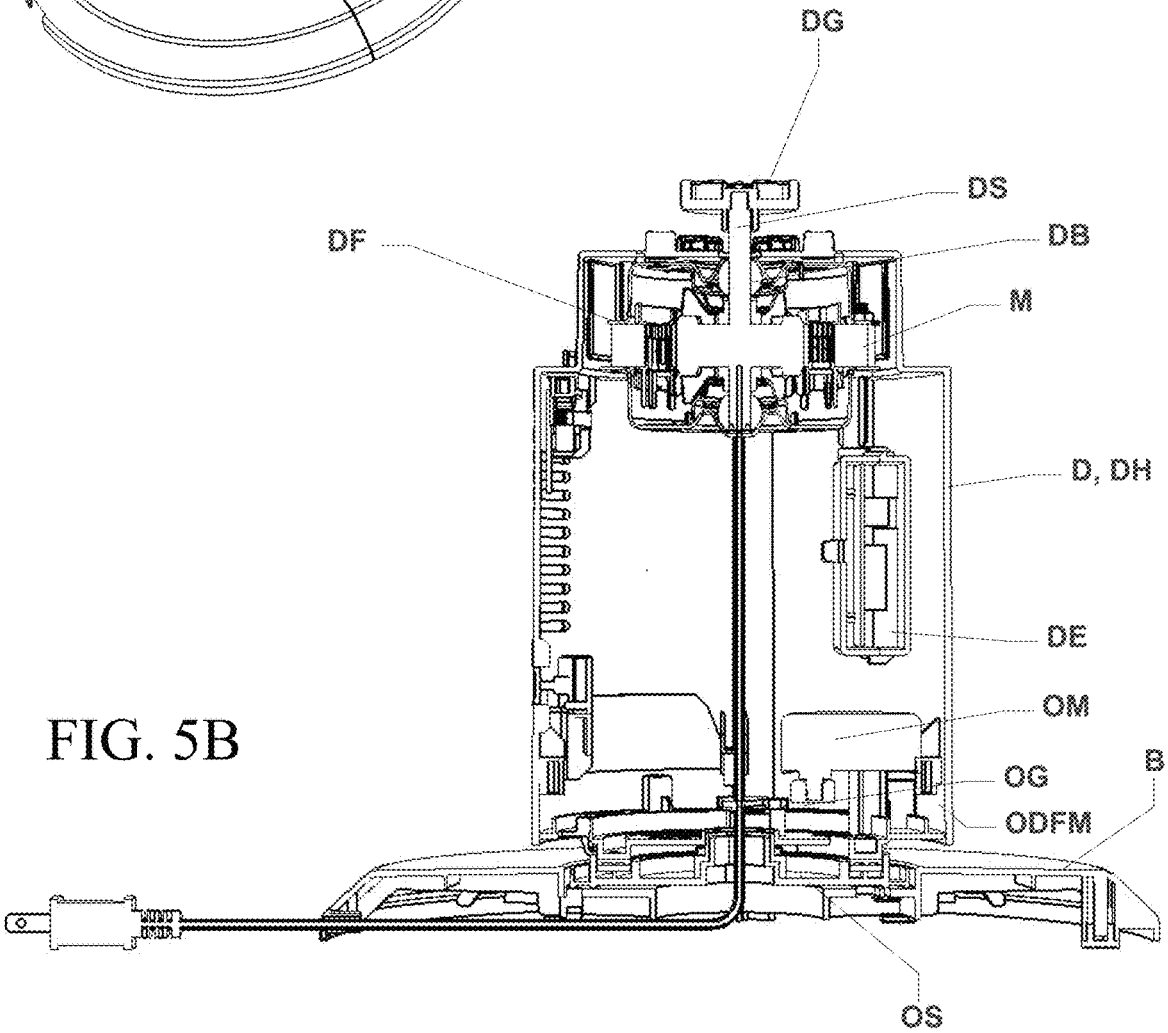
Figure 7:
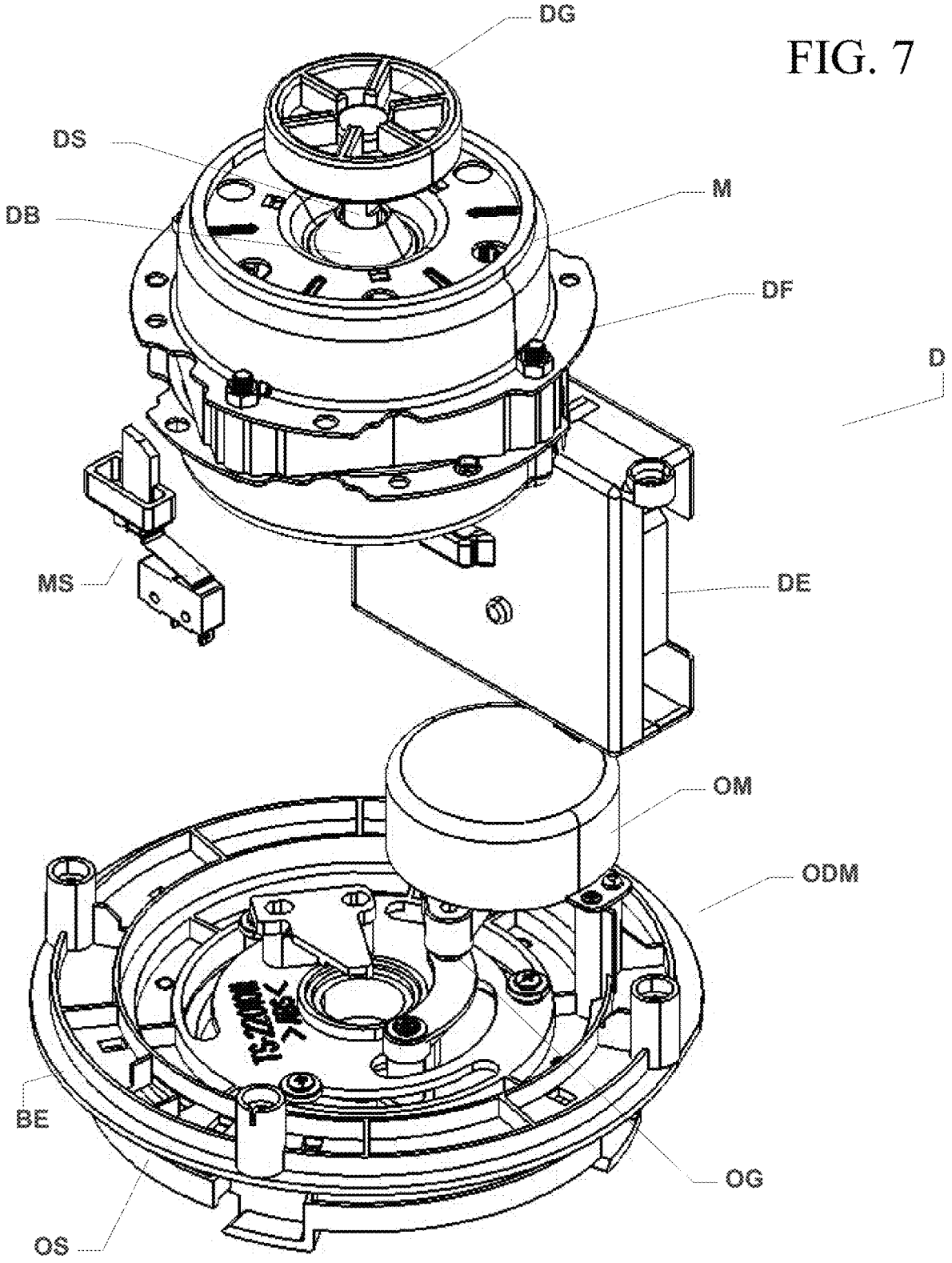
FIG. 7 is a perspective view of a drive mechanism for oscillating the drive housing, in accordance with one embodiment of the present invention.

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

The present invention provides a tower fan T that is modularized, with a separate fan module F and a separate drive module D (comprising all the electric components, e.g., drive motor, control circuitry, wirings and other electrical components that should not be exposed to fluid during cleaning). The fan housing FH of the fan module F is removably/detachably attached (e.g., by a plug and twist locking interface, a threaded interface, or using a number of quick-remove fasteners) to the drive housing DH of the drive module D during operation mode, by removably/detachably attaching the base of the fan module F to the top of the drive module D. The fan module F is user detachable from the drive module D, e.g., for cleaning mode, shipping, storing, etc., without requiring using a hand tool such as plier, screwdriver, or in an alternate embodiment, requiring minimum use of handtools if fasteners are used to couple the fan housing FH to the drive housing DH.

The fan module F includes a blower fan BF having upper and lower fan shafts UFS and LFS supported by upper and lower fan bearings UFB and LFB for rotation within a longitudinal, generally cylindrical fan housing FH. The blower fan BF rotates about a longitudinal/vertical axis in the longitudinal fan housing FH, as supported by the upper and lower fan bearings UFB and LFB provided at the two ends of the longitudinal axis within the fan housing FH. The fan housing FH includes an array of vented openings IN and OUT, louvers, grills and the like to allow air to flow into the fan housing FH and to be blown out of the fan housing FH by the rotating blower fan BF. The blower fan BF includes an array of longitudinal blades arranged radially about a central hub and the rotation axis, each extending/spanning vertically parallel to the rotation axis to form a wheel shaped blower fan BF. In one embodiment, the blower fan blade configuration can be similar to those found in conventional tower fans and U.S. Pat. No. 10,584,707.

The base of the blower fan BF is supported by a vertical drive shaft (i.e., the lower fan shaft LFS) that extends to outside of the fan housing FH, at the bottom end of the longitudinal fan housing FH that is structured to couple to the housing of the drive module D. A fan gear FG is provided at the bottom end of the lower fan shaft LFS outside the bottom of the fan housing FH for coupling to the complementary drive gear DG at the top of the drive module D. The lower fan shaft LFS can be supported by the lower fan bearing LFG within the fan housing FH located at the bottom end of the longitudinal axis of the rotating blower fan BF.

The drive module D includes a drive motor supported within a drive housing DH. Within the drive housing DH are also all the electrical components/electronics, control module, control circuitry, wirings, etc. (e.g., DE). The drive motor M has a drive shaft DS supported on a drive bearing DB for rotation, extending to outside the top of the drive housing DH. A drive gear DG is provided at the top end of the drive shaft DS outside the top of the drive housing DH for operation coupling to the fan gear FG below the bottom of the fan housing FH.

In one embodiment, the generally concave base end of the fan housing FH and the generally convex top end of the drive module D resemble the bottom of a blending jar and the top of the motor unit of a household juice blender/mixer, with the fan gear FG and the drive gear DG resembling the gears found in the household juice blender.

In one embodiment, a plug and twist locking interface is provided between the bottom of the fan housing FH of the fan module F and the top of the drive housing DH of the drive module D, including a pin pinching mechanism PM to more securely retain the fan module F in locking configuration with the drive module D. In one embodiment, a set of lugs L or slots S is provided at around the bottom of the fan housing FH and a pin pinching slot PS is provided at the bottom of the fan housing FH; a set of complementary slots S or lugs L is provided at around the top of the drive housing DH and a complementary pin P is provided at the top of the drive housing DH. In another embodiment, the pin P and pin pinching slot PS may be swapped between the drive housing DH and the fan housing FH.

To removably/detachably engage the fan module F/fan housing FH to the drive module D/drive housing DH, the bottom of the fan housing FH is rested over the top of the drive housing DH, and the fan housing FH is twisted with respect to the drive housing DH to interlock the complementary lugs L and slots S, and the pin P is pinched in the pin pinching slot PS upon such twisting. Appropriate safety switches (e.g., microswitch MS) may be additionally provided to ensure positive and complete interlocking of the fan module F and drive module D before enabling user operation of the tower fan T. When the fan housing FH of the fan module F is engaged/mounted on the drive housing DH of the drive module D, the fan gear FG operationally engages the drive gear DG for rotation. When the drive motor M rotates the drive shaft DS to rotate the drive gear DG, which in turns rotates the fan gear FG, thus rotating the blower fan BF via the lower fan shaft LFS.

To disengage the fan module F/fan housing FH from the drive module D/drive housing DH, the fan housing FH is twisted in the opposite direction in relation to the drive housing DH, and the fan housing FH is pull apart from the drive housing DH.

In another embodiment, the drive housing DH and the fan housing FH may be removably/detachably coupled by a threaded interface between the bottom of the fan housing FH and the top of the drive housing DH. The fan housing FH may be screwed onto/off the drive housing DH.

In a further embodiment, the drive housing DH and the fan housing FH may be removably/detachably coupled by using one or more fasteners (e.g., screws, bolts, snaps, inserts, tabs, twist knobs, keys, straps, and the like) that permits the user to easily undo the fasteners to allow the drive housing DH and the fan housing FH to be coupled/attached after the bottom of the fan housing FH rested on the top of the drive housing DH and decoupled/separated, e.g., without using handtools, or with minimal use of handtools, or without having to use specialized tools.

It is understood that the scope and spirit of the present invention is not limited to the specific removable/detachable coupling/attachment of the fan housing FH to the drive housing DH. In one aspect, the present invention is broadly directed to a modular tower fan comprising a fan module with its fan housing and a separate drive module with its fan housing, which modules can be removably/detachably coupled to form the overall tower fan, and providing for user decoupling/detachment of the fan module with its fan housing from the drive module with its drive housing. The drive coupling between the fan module and the drive module is via meshing complementary gears. Other types of removable/detachable coupling of fan module and drive module not specifically disclosed and illustrated herein may be implemented without departing from the scope and spirit of the present invention.

In one embodiment, the drive module D has an oscillation support OS and an oscillation drive mechanism ODM that are part of the drive module D. The oscillation support OS is located outside the bottom end BE of the drive housing DH. In one embodiment, the drive motor M may be supported by a drive frame DF within and towards the top of the drive housing DH. The oscillation drive mechanism ODM comprises a separate, smaller, oscillation drive motor OM provided in the drive housing DH, and attached to the top of the oscillation support OS, to rotate the drive housing DH in relation to the oscillation support OS in an oscillating or swinging manner (e.g., over a swing angle of 60 to 90 degrees, at 3 to 5 RPM swing/oscillation rate). In one embodiment, the drive housing DH may be coupled to the oscillation drive motor OM on the oscillation support OS via a set of oscillation drive gears and/or levers OG driven by the oscillation drive motor OM to oscillate/swing the drive housing DH relative to the oscillation support OS, in a similar manner as found in the oscillation coupling between a tower fan housing and the ground support base in conventional tower fans. In the drive module D of the present invention, the drive housing DH of the drive module D can be driven to rotate in oscillation with respect to the oscillation support OS in a similar fashion.

The oscillation support OS is attached (e.g., removably/detachably attached) to a wider ground support base B to provide a sturdier support of the overall tower fan structure. Hence, the drive housing DH is driven to rotate in oscillation with respect to the ground support base B. As the drive housing DH of the drive module D rotates in oscillation, the fan module F attached to and supported by the drive module D can be directed in changing directions as the fan housing FH is rotated in oscillation with respect to the ground support base B during oscillation operation.

In one embodiment, the oscillation support OS is removably/detachably attached to the ground support base G, using a plug and twist locking interface, including complementary lugs L2 and slots S2 and a pin pinching mechanism PM2 (complementary pin P2 and pin pinching slot PS2) to provide a secure locking configuration and yet detachable, similar to the engagement interface between the fan module F/fan housing FH and the drive module D/drive housing DH. Upon attachment of the oscillation support OS to the ground support base B, a locking screw or index key K may be provided to prevent relative rotation between the oscillation support OS and ground support base B.

For further enhancement of the tower fan T, illumination may be provided as part of the drive module D. For example, a string or tube LED light LD (e.g., a night light) may be provided around the drive housing DH, with the LED control electronics provide within the drive housing DH. The LED light LD provides illumination, improves ambience of the room, and also acts as a warning to avoid people running into the tower fan when the room is dark.

User control of the tower fan T may be provided by a user control interface (e.g., comprising one or more switches/buttons SW) provided on the drive housing DH, and/or a wireless control (e.g., a wireless remote control R) that communicates wirelessly (e.g., by Bluetooth, wifi, infrared, RF, etc.) with a receiver provided in the control module within the drive module D/drive housing DH. The user control interface (SW) on the drive housing DH may have limited on/off and fan speed controls to be available for use as a backup in the event the wireless control is not available (e.g., a misplaced wireless remote control). Since there is no separate user control interface (e.g., buttons, switches, etc.) in the fan module F, and hence there is no need for electrical wiring to be provided in the fan module F. The remote control R includes buttons that provide a user interface to various tower fan operation control function, such as on/off, fan speed, fan oscillation modes (e.g., which may include a breeze mode), operation timers, etc.

To facilitate ease of user control of the tower fan, the remote control R may be removably/detachably attached to the fan housing FH (e.g., at the top of the fan housing FH). In one embodiment, the remote control R may be magnetically attached to the fan housing FH, or by means of Velcro fasteners, snap fasteners, hook fasteners, pocket, docking slot, etc. In one embodiment (FIG. 1A), a docking slot DK is provided (e.g., at the top of) the fan housing FH, which slot is sized to receive the remote control R. The docking slot DK may have a depth that receives the thickness of the remote control R such that the top surface of the remote control R is flush against the surface at the top of the fan housing FH, so as to blend in to appear as if the remote control R is part of the exterior of the fan housing FH. When the remote control R is placed in the docking slot DK, a user can control the operations of the tower fan T by activating the buttons/switches on the remote control R; to a casual viewer, the remote control R appears to be a built-in user control interface that is provided in the fan module F, even though it communicates wirelessly with the drive module D. The remote control R can be securely removably attached to the fan housing FH by a magnetic coupling between the bottom of the remote control and the fan housing FH. Alternatively, other types of removable fasteners, such as Velcro and snap fasteners may be used.

In another embodiment, a wireless control could be made a built-in, non-user-detachable part of the fan housing FH, so that wiring is not needed to communicate control signals between the wireless control and the drive module D. Further, an additional, separate wireless remote control (such as R) may be provided to facilitate a user to remotely and wireless control the drive module D at a distance to the tower fan T. In a specific embodiment, a wireless control could be permanently or semi-permanently housed in a detachable or non-detachable, waterproof or water-insulated chamber of the fan housing FH, so that only a small limited part of the fan housing FH contains low voltage (direct current (DC)) electronics/electrical components that are well protected from water intrusion. In any event, hard wiring is not needed to communicate control signals between the wireless control and the drive module D to control operation of the tower fan.

In yet another embodiment, alternatively or in addition, an application module installed in an electronic device (e.g., a mobile phone) may be used to generate the remote-control signal, and further to include additional 'smart' monitoring and/or control functions.

As can be seen from the foregoing description, in accordance with the present invention, there is no electrically conductive hard wire interface between the fan module F/housing and the drive module D/housing. The wireless interface between the remote control and the drive module D is not an electrically conductive hard wire interface. The fan module F is free of high voltage (alternate current (AC)) electrical and/or electronic components, necessary for operating and/or controlling the operation of the tower fan. The drive module D contains the necessary electrical/electronic components to control/operate the tower fan T, subject to control request by the user using the wireless remote control R or built-in wireless interface if provided in the fan module F.

It is within the scope and spirit of the invention to include a possible embodiment of a fan module F have some electrical/electronic parts housed in a water-proof compartment, which components are not electrically conductively hard-wire connected to the drive module D when in operation. For example, a light operated by a battery may be provided on the fan module F, as contained in a water-proof compartment. Or a wireless controller embedded in a water-proof compartment for wireless control of the drive module D, as discussed above.

Given there is no electrical/electronic components in the fan module F for control of the drive module D, it can be cleaned easily and frequently by simply detaching the fan module F from the drive module D and rinsing the fan module F in a bucket, or under running water (e.g., from a water hose) and/or cleaning fluid, without fear of damaging any electrical/electronic components. The user does not need to use any tool to disassemble the fan module F by first disassembling the fan housing FH to reach the blower fan blades, which makes cleaning the blower fan blades, and also the air vents/louver/grills, much easier to undertake by the user. There would be less dirt and allergens accumulated on the fan housing FH which would otherwise negatively affect user health.

With the modularized nature of the fan module F and drive module D, a drive module D could work with various fan modules of different heights (i.e., different longitudinal length), different blower/air moving capacities, and different aesthetics (e.g., colors, trims, materials, etc.), and different housing external shapes. From the manufacturer's perspective, there will be less parts to stock for a variation of tower fans of different heights, etc. using the same drive module D. The drive module D becomes the "footprint" or the "form factor" for a variety of tower fans. Manufacturing and/or warehousing costs can be minimized.

While the present invention has been described above in connection with the illustrated embodiments, the scope of patent invention covers all possible present and future variations and improvements that is apparent from the disclosure above. While the invention has been particularly shown and described with reference to the preferred embodiments, it will be understood by those skilled in the art that various changes in form and detail may be made without departing from the spirit, scope, and teaching of the invention. Accordingly, the disclosed invention is to be considered merely as illustrative and limited in scope only as specified in the claims.

The invention claimed is:

1. A modular tower fan, comprising:

a fan module having a fan housing, wherein the fan housing comprises a blower fan and bearings supporting the blower fan for rotation within the fan housing, and a fan gear provided at a bottom of the fan housing for rotating the blower fan;

a drive module having a drive housing, wherein the drive module comprises a drive motor, control circuitry, wirings and other electrical components within the drive housing, and a drive gear at a top of the drive housing driven by the drive motor, wherein the fan housing of the fan module is removably/detachably attached to the drive housing of the drive module with the fan gear operational coupled to the drive gear for rotation, and wherein the fan module is detachable from the drive module for cleaning mode, shipping or storage with the fan gear decoupled from the drive gear; and a wireless control that communicates wirelessly with a receiver provided in a control module provided within the drive housing of the drive module, providing a user interface to activate various tower fan operation control functions, wherein there is no separate user control interface communicating with the drive module other than the wireless control, and no electrical wiring in the fan module between the wireless control and the drive module, and no electrically conductive interface between the fan module and the drive module, wherein the wireless control is removably/detachably attached to a top of the fan housing without any hard wiring to communicate control signals between the wireless control and the drive module, facilitating user control of operational functions of the drive module to control operations of the tower fan, wherein a docking slot is provided at the top of the fan housing, which slot is sized to receive the wireless control, wherein the docking slot has a depth to accommodate thickness of the wireless control such that top surface of the wireless control is flush against the top of the fan housing, so as to blend in to appear as if the wireless control is part of exterior of the fan housing to a casual viewer, with the wireless control appearing to be a built-in user control interface provided at the top of the fan module, wherein with the wireless control placed in the docking slot, a user can control the operations of the tower fan by activating buttons/switches on the wireless control, and wherein the wireless control is magnetically attached to the top of the fan housing.

2. The modular tower fan as in claim 1, wherein the wireless control communicates with the drive module by RF signals.

3. The modular tower fan as in claim 1, wherein the drive module is configured to receive a wireless control signal generated from an application module installed in a mobile electronic device.

4. The modular tower fan as in claim 1, wherein the fan module comprises a blower fan having a fan shaft supported by bearings for rotation within the fan housing, and wherein the blower fan rotates about a vertical longitudinal axis in the fan housing, supported by bearings provided at two ends of the longitudinal axis within the fan housing.

5. The modular tower fan as in claim 4, wherein the fan housing comprises an array of vented openings to allow air to flow into the housing and to be blown out of the housing by the blower fan, and wherein the blower fan comprises an array of longitudinal blades arranged radially about the fan shaft, each extending vertically parallel to the fan shaft to form a wheel shaped blower fan.

6. The modular tower fan as in claim 5, wherein the fan module further comprises a fan gear provided at the bottom end of the fan shaft outside a bottom of the fan housing for coupling to a complementary drive gear provided at a top of the drive module, and wherein the fan shaft is supported to extend from the bearing within the fan housing located at the bottom end of the longitudinal axis of the blower fan.

7. The modular tower fan as in claim 1, wherein the drive motor has a drive shaft supported on a bearing for rotation, extending to outside the top of the drive housing, and wherein the drive gear is provided at the top end of the drive shaft outside the top of the drive housing for coupling to the fan gear below the bottom of the fan housing.

8. The modular tower fan as in claim 7, wherein to removably/detachably engage the fan module to the drive module, the bottom of the fan housing is rested over the top of the drive housing, and the fan housing is twisted with respect to the drive housing to interlock complementary lugs and slots provided at the interfacing fan housing bottom and drive housing top, and wherein to disengage the fan module from the drive module, the fan housing is twisted in the opposite direction in relation to the drive housing.

9. A modular tower fan, comprising:

a fan module having a fan housing, wherein the fan housing comprises a blower fan and bearings supporting the blower fan for rotation within the fan housing, and a fan gear provided at a bottom of the fan housing for rotating the blower fan;

a drive module having a drive housing, wherein the drive module comprises a drive motor, control circuitry, wirings and other electrical components within the drive housing, and a drive gear at a top of the drive housing driven by the drive motor, wherein the fan housing of the fan module is removably/detachably attached to the drive housing of the drive module with the fan gear operational coupled to the drive gear for rotation, and wherein the fan module is detachable from the drive module for cleaning mode, shipping or storage with the fan gear decoupled from the drive gear; and a wireless control that communicates wirelessly with a receiver provided in a control module provided within the drive housing of the drive module, providing a user interface to activate various tower fan operation control functions, wherein the drive motor has a drive shaft supported on a bearing for rotation, extending to outside the top of the drive housing, and wherein the drive gear is provided at the top end of the drive shaft outside the top of the drive housing for coupling to the fan gear below the bottom of the fan housing, wherein to removably/detachably engage the fan module to the drive module, the bottom of the fan housing is rested over the top of the drive housing, and the fan housing is twisted with respect to the drive housing to interlock complementary lugs and slots provided at the interfacing fan housing bottom and drive housing top, and wherein to disengage the fan module from the drive module, the fan housing is twisted in the opposite direction in relation to the drive housing, and wherein the drive module further comprises an oscillation support, wherein the oscillation support is located outside the bottom end of the drive housing, and wherein a separate oscillation drive motor is provided in the drive housing to rotate the drive housing in relation to the oscillation support in an oscillating or swinging manner.

* * * * *